US006227343B1

(12) United States Patent
Neathway et al.

(10) Patent No.: US 6,227,343 B1
(45) Date of Patent: May 8, 2001

(54) DUAL COIL COIN IDENTIFIER

(75) Inventors: Graham Neathway, Almonte; Bill Kiss, Ottawa, both of (CA)

(73) Assignee: Millenium Enterprises Ltd., Hamilton (BM)

( * ) Notice: Subject to any disclaimer, the term of this patent is extended or adjusted under 35 U.S.C. 154(b) by 0 days.

(21) Appl. No.: 09/281,607

(22) Filed: Mar. 30, 1999

(51) Int. Cl.[7] ..... G07D 5/08
(52) U.S. Cl. ..... 194/319
(58) Field of Search ..... 194/317, 318, 194/319

(56) References Cited

U.S. PATENT DOCUMENTS

| | | | |
|---|---|---|---|
| 2,540,063 | 1/1951 | Victoreen | 235/98 |
| 2,642,974 | 6/1953 | Ogle . | |
| 3,059,749 | 10/1962 | Zinke . | |
| 3,242,932 | 3/1966 | Becker . | |
| 3,373,856 | 3/1968 | Kusters et al. . | |
| 3,378,126 | 4/1968 | Kuckens et al. . | |
| 3,565,283 | 2/1971 | Sciacero et al. | 221/197 |
| 3,587,809 | 6/1971 | Meloni . | |
| 3,599,771 | 8/1971 | Hinterstocker . | |
| 3,682,286 | 8/1972 | Prumm . | |
| 3,738,469 | 6/1973 | Prumm . | |
| 3,796,295 | 3/1974 | Montolivo et al. . | |
| 3,901,368 | 8/1975 | Klinger . | |
| 3,918,564 | 11/1975 | Heiman et al. . | |
| 4,078,646 | 3/1978 | Kiehl | 194/83 |
| 4,091,908 | 5/1978 | Hayashi et al. . | |
| 4,105,105 | 8/1978 | Braum . | |

(List continued on next page.)

FOREIGN PATENT DOCUMENTS

| | | | |
|---|---|---|---|
| 54739/80 | 1/1980 | (AU) | G07F/3/02 |
| 1336782 | 4/1986 | (CA) | G07D/5/04 |
| 2021709 | 7/1994 | (CA) | G07C/1/30 |
| 2139144 | 12/1994 | (CA) | G07F/7/02 |
| 3522229 | 6/1985 | (DE) | G07D/5/08 |
| 2212589 | 7/1974 | (FR) | G07F/3/00 |
| 1401363 | 7/1975 | (GB) | G07F/3/02 |
| 2020469 | 11/1979 | (GB) | G07F/3/02 |
| 56-11182 | 3/1981 | (JP) | G07D/5/08 |
| 58-6985 | 2/1983 | (JP) | G07D/5/08 |
| 58-30632 | 6/1983 | (JP) | G07D/5/08 |

*Primary Examiner*—F. J. Bartuska
(74) *Attorney, Agent, or Firm*—Hayes, Soloway, Hennessey, Grossman & Hage, P.C.

(57) ABSTRACT

The coin identification device comprises a gravity fed chute structure having an opening for receiving a coin to be identified, walls to guide the coin as it moves through the chute and an opening for the coin to exit. A wake-up circuit with sensing coils mounted near the chute opening provides an output signal when the presence of a coin is detected. Two coin sensing circuits, each having an oscillator with a particular coil arrangement are used to sense the characteristics of the coin passing through them. The first coin sensing circuit includes a coil arrangement having a coil mounted on the chute with its axis in the direction of the coin path such that the coin will pass through it and forming part of a first oscillator to create lines of flux parallel to the coin path. The second coin sensing circuit includes a coil arrangement having a coil mounted on a U-shaped core with two substantially parallel legs connected at one end by an arm that is mounted about the chute to have the coin pass in the gap between the core legs. The second coil arrangement forms part of a second oscillator to create lines of flux perpendicular to the plane of the coin passing through the chute. The first and second oscillators are adapted to oscillate at one or more base frequencies. The frequency shift of the first oscillator is measured as the coin passes through the first magnetic field and the frequency shift of the second oscillator is measured as the coin passes through the second magnetic field to generate signatures of the coin characteristics. A microprocessor compares the generated signatures to known coin signatures to identity of the coin.

31 Claims, 6 Drawing Sheets

U.S. PATENT DOCUMENTS

| | | | | |
|---|---|---|---|---|
| 4,108,296 | | 8/1978 | Hayashi et al. . | |
| 4,124,111 | | 11/1978 | Hayashi . | |
| 4,128,158 | | 12/1978 | Dautremont, Jr. . | |
| 4,151,904 | | 5/1979 | Levasseur et al. . | |
| 4,206,775 | | 6/1980 | Tanaka . | |
| 4,234,071 | | 11/1980 | Le-Hong . | |
| 4,286,704 | | 9/1981 | Wood . | |
| 4,323,148 | | 4/1982 | Nichimoto et al. . | |
| 4,326,621 | | 4/1982 | Davies . | |
| 4,353,453 | | 10/1982 | Partin et al. . | |
| 4,371,073 | | 2/1983 | Dubey . | |
| 4,416,365 | * | 11/1983 | Helman | 194/317 |
| 4,436,196 | | 3/1984 | Crisp et al. . | |
| 4,437,558 | | 3/1984 | Nicholson et al. . | |
| 4,460,080 | | 7/1984 | Howard . | |
| 4,462,513 | * | 7/1984 | Dean et al. | 194/318 |
| 4,469,213 | | 9/1984 | Nicholson et al. . | |
| 4,556,140 | | 12/1985 | Okada . | |
| 4,705,154 | | 11/1987 | Masho et al. | 194/319 |
| 4,798,273 | | 1/1989 | Ward, II | 194/350 |
| 4,823,928 | | 4/1989 | Speas | 194/217 |
| 4,827,206 | | 5/1989 | Speas | 323/299 |
| 4,842,119 | | 6/1989 | Abe | 194/317 |
| 4,872,149 | | 10/1989 | Speas | 368/90 |
| 4,880,097 | | 11/1989 | Speas | 194/239 |
| 4,880,406 | | 11/1989 | Van Horn et al. | 464/38 |
| 4,881,631 | | 11/1989 | Ward, II | 194/228 |
| 4,895,238 | | 1/1990 | Speas | 194/319 |
| 4,920,824 | | 5/1990 | Ward, II | 74/553 |
| 4,967,895 | | 11/1990 | Speas | 194/200 |
| 5,088,073 | | 2/1992 | Speas | 368/90 |
| 5,109,972 | | 5/1992 | Van Horn et al. | 194/217 |
| 5,119,916 | | 6/1992 | Carmen et al. | 194/210 |
| 5,135,096 | | 8/1992 | Ward, II | 194/224 |
| 5,155,614 | | 10/1992 | Carmen et al. | 359/189 |
| 5,180,046 | | 1/1993 | Hutton et al. | 194/319 |
| 5,184,707 | | 2/1993 | Van Horn et al. | 194/204 |
| 5,244,070 | | 9/1993 | Carmen et al. | 194/319 |
| 5,259,491 | | 11/1993 | Ward, II | 194/350 |
| 5,273,151 | | 12/1993 | Carmen et al. | 194/319 |
| 5,293,980 | * | 3/1994 | Parker | 194/317 |
| 5,351,798 | | 10/1994 | Hayes | 194/318 |
| 5,360,095 | | 11/1994 | Speas | 194/217 |
| 5,382,780 | | 1/1995 | Carmen | 235/384 |
| 5,439,089 | | 8/1995 | Parker | 194/317 |
| 5,450,755 | | 9/1995 | Saito et al. | 73/763 |
| 5,475,373 | | 12/1995 | Speas | 340/815.58 |
| 5,526,662 | | 6/1996 | Diekoff et al. | 70/278 |
| 5,568,854 | * | 10/1996 | Hayes et al. | 194/319 X |
| 5,614,892 | | 3/1997 | Ward, II et al. | 340/870.02 |
| 5,617,942 | | 4/1997 | Ward, II et al. | 194/217 |

* cited by examiner

Delta Frequency readings for the Low and high Freqency U and O oscillator

| AVERAGE | Coin#1 | Coin#2 | Coin#3 | Coin#4 | Coin#5 | Coin#6 | Coin#7 | Coin#8 | Coin#9 |
|---|---|---|---|---|---|---|---|---|---|
| Low freq. - u | 10.2% | 7.1% | 12.1% | 14.9% | 16.1% | 11.2% | 8.6% | 14.0% | 11.0% |
| High Freq. - u | 8.8% | 5.9% | 10.5% | 13.1% | 14.9% | 9.8% | 6.7% | 11.0% | 9.6% |
| Low freq - 0 | 15.4% | 11.2% | 16.6% | 20.1% | 16.1% | 4.4% | 3.0% | 5.2% | 3.6% |
| High Freq. - 0 | 12.8% | 9.2% | 13.8% | 16.9% | 14.3% | 7.8% | 5.2% | 6.8% | 7.2% |
| U-OSC | | | | | | | | | |
| Low freq. min. | 9.6% | 6.6% | 11.3% | 14.0% | 15.1% | 10.6% | 7.9% | 13.1% | 10.3% |
| Low freq. max. | 10.8% | 7.6% | 12.9% | 15.8% | 17.1% | 11.8% | 9.3% | 14.8% | 11.7% |
| High Freq. min. | 7.6% | 4.5% | 9.3% | 12.1% | 13.3% | 8.3% | 5.3% | 10.3% | 8.2% |
| High Freq. max. | 10.0% | 7.3% | 11.8% | 14.1% | 16.5% | 11.3% | 8.0% | 11.8% | 10.9% |
| O-OSC | | | | | | | | | |
| Low freq. min. | 14.4% | 10.4% | 15.4% | 19.3% | 15.2% | 4.0% | 2.5% | 4.9% | 3.2% |
| Low freq. max. | 16.3% | 11.9% | 17.8% | 20.9% | 17.0% | 4.9% | 3.4% | 5.6% | 4.1% |
| High Freq. min. | 11.0% | 7.6% | 11.7% | 16.1% | 12.5% | 6.0% | 3.7% | 5.5% | 5.7% |
| High Freq. max. | 14.6% | 10.9% | 16.0% | 17.8% | 16.0% | 9.6% | 6.6% | 8.1% | 8.7% |

FIG. 9

DUAL COIL COIN IDENTIFIER

FIELD OF THE INVENTION

This invention relates generally to electronic coin sensing devices, and more particularly to devices for identifying a variety of coins.

BACKGROUND OF THE INVENTION

Over the years, various types of coin operated mechanisms such as parking meters, pay phones, photocopiers and vending machines have been developed to more effectively and efficiently provide automated services. These mechanisms usually accept the coins of the country in which they are located, however on occasion, other coins such as tokens might also be accepted by them. It has further been determined that it is not enough for a device to distinguish between the different coins from one country which are usually quite dissimilar, it is also necessary to be able to distinguish coins from several countries. In the latter case, coins are sometimes very similar physically, but not in denomination.

With the proliferation of coins around the world and the increased travel between countries, it is becoming more important to be able to distinguish coins from different countries and to distinguish between genuine coins, tokens and fake coins. Slugs and blanks can easily be made to resemble genuine domestic and foreign coins. Dependable coin identification requires sensitive and precise analysis.

Early coin operated devices were equipped to determine the denomination of a small number of coins. Typical prior art mechanisms served to discern the type and validity of the coin by means of various selectors of the mechanical or electro-mechanical type based on the geometric characteristics of the coins such as diameter, thickness, nature of the rim, whether smooth or knurled, the presence or absence of central bores, or on the basis of other physical characteristics of the coin such as weight. Such devices are generally not suitable to discard counterfeit coins particularly when the physical characteristics of the counterfeit coin are made to be close to those of a genuine coin.

More recent prior art devices utilize electronic sensors, rather than selectors of the mechanical or electromechanical type. The analysis of the coins is thereby performed on the basis of one or more electrical characteristics of the material or materials from which the coins are made, such as the magnetic permeability of the coins or their electrical conductivity, in addition to their physical characteristics.

Recently developed electronic devices are also more reliable and require less maintenance and servicing than the older type mechanical devices in that they have fewer if any moving parts.

Present day coin discriminating devices use a combination of electronic sensors to determine the signatures of a coin. As a typical example, U.S. Pat. No. 4,895,238 that issued to Speas on Jan. 23, 1990 describes a coin discriminator that has 4 sensors. The first sensor signals the presence of a coin. The second, a Hall-effect metal detector, senses the presence of any ferrous metal. The third sensor, an infrared LED/photo diode system, detects the coin diameter. The fourth sensor, a coil that causes the frequency of an oscillator to shift as a coin passes it, senses the metallic content of the coin. Thus two or more signatures of the coin are produced when the coin passes by the sensors. These signatures are compared with previously stored values and if the result of the comparison is within established limits the coin is identified and can be accepted. If the comparison result is outside the established limits, the coin can be rejected.

Further, as described in the above U.S. Patent, it is also common for the mechanism using the coin discriminator to have a main controller or microprocessor that receives signals from the sensors to control LCD displays and perform other functions such as detecting the presence of a vehicle through sonar and transmitting information to and from the mechanism through an infrared transceiver.

In order to simplify the sensing process, it has been found that the signatures for various coins can be obtained using only coils. U.S. Pat. No. 4,705,154 that issued to Masho et al on Nov. 10, 1987 describes a coin selection apparatus wherein two sets of coils are positioned along the path that a coin travels. The first set includes a pair of coils positioned on either side of the coin path and connected in series and in phase to establish flux lines across the path. The second set includes a pair of coils positioned on either side of the coin path and connected in series but in opposite phase to establish flux lines along the path. Both sets of coils are further connected in series to form part of a resonance circuit for an oscillator. As the coin passes the coils, the oscillator circuit detects a change in impedance in the coils and produces a change in the oscillator voltage output providing identifying signatures for the coin in question.

U.S. Pat. No. 5,244,070 that issued to Carmen et al on Sep. 14, 1993, also describes a dual coil coin sensing apparatus. In this particular apparatus, a pair of coils are placed along a coin path such that a coin will pass sequentially through the two coils which each establish flux lines along the path. The coils are connected in series as part of a resonance circuit in the feedback path of an oscillator circuit such that the frequency of the oscillator shifts as the coin passes by the coils. The shift in frequency provides identifying signatures for the coin which are compared to standard values stored in a table to determine the denomination of the coin if it is valid.

With the influx of coins from different countries as well as the ability to produce inexpensive counterfeits, it is more important then ever to be able to identify whether coins are genuine or not, and to identify their denomination.

SUMMARY OF THE INVENTION

It is therefore an object of this invention to provide a method and apparatus for accurately sensing coins.

It is a further object of this invention to provide a method and apparatus for accurately identifying coins in real time.

These and other objects are achieved in a method and device for identifying coins in accordance with the present invention in which the coin to be identified is sequentially directed through two oscillating magnetic fields wherein the flux lines in one of the magnetic fields are substantially parallel to the plane of the coin and the flux lines of the other magnetic field are substantially perpendicular to the plane of the coin. The frequency shifts of the magnetic fields are measured as the coin passes through them to provide signatures representing characteristics of the coin. These signatures are then compared to known coin signatures to determine the identity of the coin in question.

In accordance with another aspect of the invention, two or more signatures can be obtained by switching the base frequencies of the two oscillating magnetic fields as the coin is passing through the fields. If two base frequencies are used for each field, each field will produce two distinct signatures for the coin resulting in a total of four signatures that may be compared to known coin signatures.

With regard to a specific aspect of present invention, the coin identification device includes two coil arrangements, each connected into the feedback circuits of separate oscillators whereby the base frequencies of the oscillators shift when the coin passes by their respective coil arrangements. The coil arrangements are mounted in any sequence on a gravity fed chute structure having an opening for receiving the coin, walls to guide the coin as it moves downward and an opening for the coin to exit.

In accordance with another specific aspect of the invention one of the coil arrangements comprises a hollow coil mounted about the chute such that the coin will pass through it as it moves through the chute. The other coil arrangement comprises a U-shaped core having two substantially parallel legs connected at one end by an arm with one or more coils mounted on the core. The U-shaped core is also mounted about the chute such that the coin will pass through the gap between the legs of the core. In addition, shielding may be placed on three sides and the end of the legs in order to concentrate the flux in the gap between the U-core legs.

Many other objects and aspects of the present invention will be clear from the detailed description of the drawings.

BRIEF DESCRIPTION OF THE DRAWINGS

Embodiments of the invention are described with reference to the drawings in which:

FIG. 9 is a table of four delta frequency ranges providing signature values for each of a variety of nine coins sensed by an O-coil oscillator and a U-coil oscillator that are switched between a base frequency f1 of 50 kHz and a base frequency f2 of 100 kHz.

DETAILED DESCRIPTION OF THE DRAWINGS

The present invention generally applies to any one of a variety of different coin operated applications where coin identification is required, such as vending machines, photocopiers or telephones as well as in applications where small, modular, low power, intelligent electronic coin validators are required, such as parking meters. The novel coin identification device of the present invention can be utilized with a predetermined number of coins, whether they are legal tender from one or more countries, tokens or counterfeit coins.

The present invention will be described in conjunction with an electronic parking meter. These meters may be energized from power mains or by battery that may be charged by a solar collector in certain applications. The typical meter also has a coin slot connected to a coin chute into which the client inserts coins to operate the meter and a display for displaying the time remaining on the meter. In more recent meters, the displays are electronic.

Figure 1:
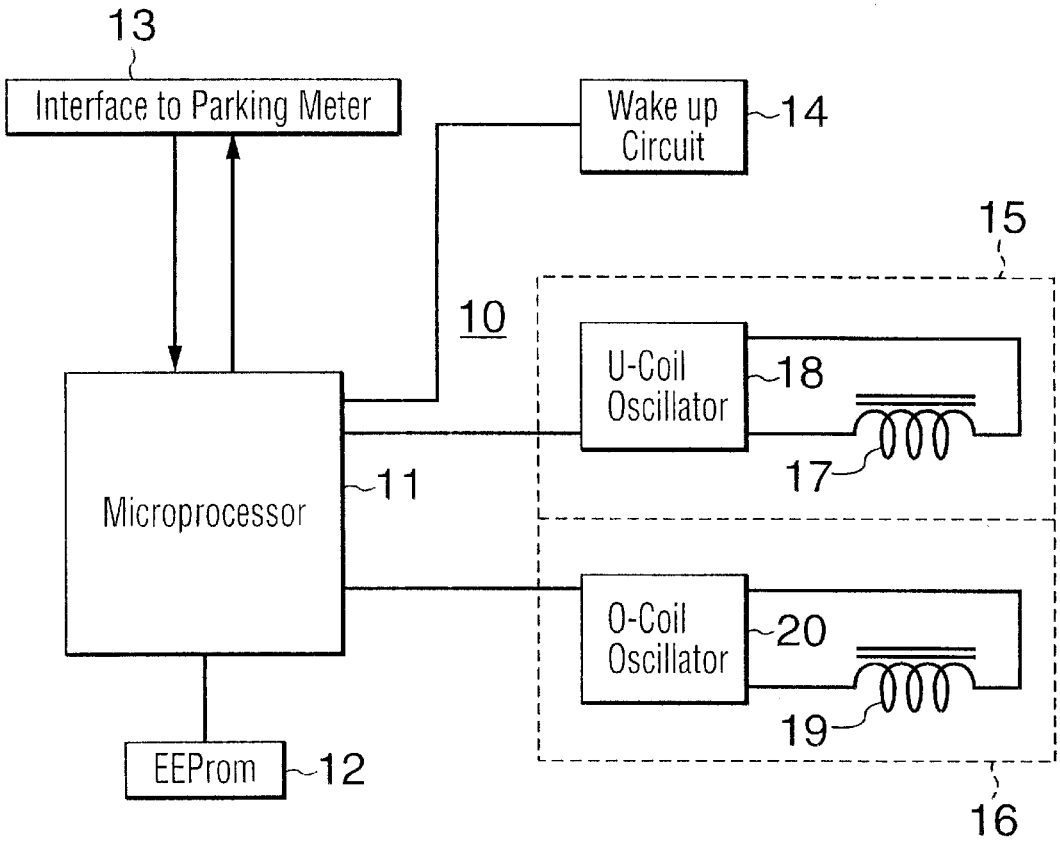
FIG. 1 is a block diagram of the coin identifying device in accordance with the present invention.

FIG. 1 illustrates a block diagram of the coin identifying device 10 in accordance with the present invention. Device 10 includes a microprocessor 11 connected to an appropriate memory 12. In cases where it is desirable to have a self contained module, the microprocessor 11 may be devoted to the coin identification functions with an interface 13 linking it to the parking meter. In other cases, microprocessor 11 may be the only processor for the coin operated mechanism and is shared between the coin identification function and all other parking meter functions. In order to save power particularly where batteries are the only energy source, the microprocessor would have a default low power consumption standby mode and its normal operational mode.

The coin identifying device 10 further includes a wake-up circuit 14 connected to the microprocessor 11. Circuit 14 detects when a coin is inserted into the apparatus coin slot and provides a signal to the microprocessor 11 that switches it from the standby mode to the operational mode. Coin detection can be carried out in many ways such as by infrared diode/LED arrays, mechanical switches and coil detectors. In this particular embodiment, the wake-up circuit 14 with coil detectors that is used is described in Canadian Patent Application 2,173,428 to Bushnik, Campbell, Chauvin, Church & Pincock that was opened to public inspection on Oct. 7, 1996. It will be described in detail in conjunction with FIG. 2.

The microprocessor 11 is further connected to two coin sensing circuits 15 and 16 that use coils to sense various characteristics of a coin as it moves through the coin chute. Circuits 15 and 16 each consist of a coil arrangement 17, 19 connected into the feedback tank circuit of an oscillator 18, 20 operating sequentially at one or more predetermined base frequencies. The base frequency of the oscillator 18, 20 shifts as the coin passes by its respective coil arrangement 17, 19. Circuits 15 and 16 are described in detail in conjunction with FIG. 3. The coil arrangements 17, 19 differ from one another. One of the coil arrangements 17 creates a magnetic flux pattern such that the flux lines are perpendicular to the plane of the coin as the coin passes the arrangement 17. The resulting frequency shift of oscillator 18 is affected primarily by the coin diameter, and to a lesser extent by the thickness and material of the coin. The other coil arrangement 19 creates a magnetic flux pattern such that the flux lines are parallel to the plane of the coin as the coin passes by the arrangement 19. The resulting frequency shift of oscillator 20 is also affected by the characteristics of the coin, however quite differently than the frequency shift of oscillator 18. Thus the percentage frequency shift of oscillators 18 and 20 will each provide a distinct signature for each particular coin passing through the coil arrangements 17 and 19.

It is further to be noted that the sensing circuits 15 and 16 operate independently one from the other and that the sensors can be mounted on the coin path in either sequence.

Figure 2:
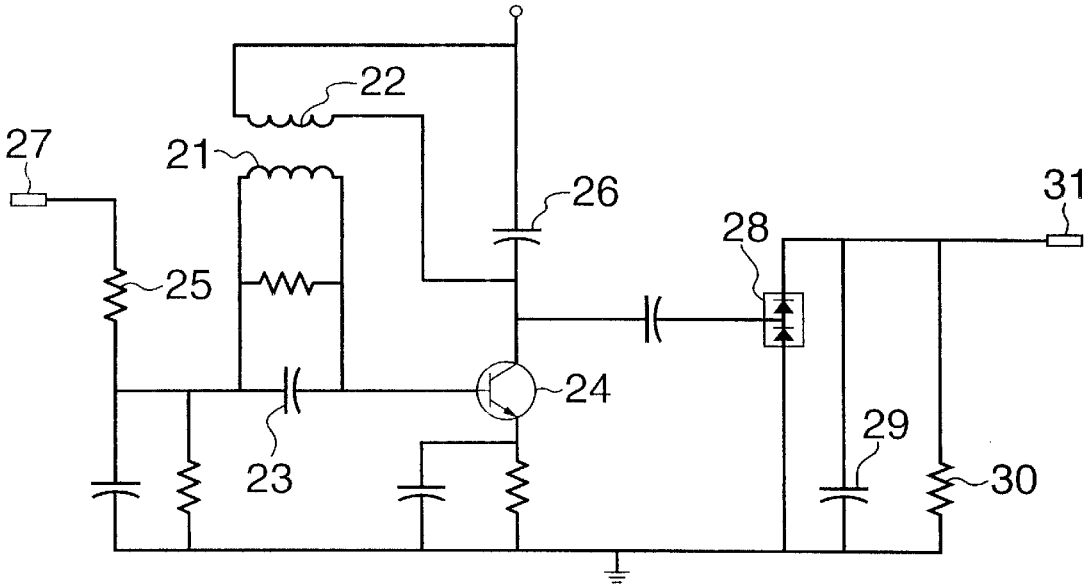
FIG. 2 illustrates one embodiment of a wake-up circuit referred to in FIG. 1.

The proximity detector 14 as illustrated in FIG. 2 is implemented with an inductively coupled oscillator. Detector 14 includes a tuned circuit that is formed by a capacitor 23 in parallel with an air core coil 21 connected to the base of a transistor 24 and a second capacitor in parallel with a second air core coil 22 connected to the collector of transistor 24. For oscillation to start, a biasing voltage controlled by the microprocessor 11 is applied to resistor 25 through terminal 27, allowing transistor 24 to turn on. Oscillation is maintained due to out-of-phase coupling between the two coils 21 and 22 which are mounted on the coin chute as will be described in FIG. 4. When the inductive coupling between the coils 21 and 22 is broken by a coin passing through them, the oscillator stops. Thus when a coin is not present the oscillator oscillates freely, the signal is rectified through diode 28 and filtered capacitor 29 and resistor 30 to provide an output voltage at terminal 31 for the microprocessor 11. When a coin is present between the coils 21 and 22, the oscillator stops oscillating providing no signal at terminal 31.

In operation, the microprocessor 11 samples the coin detector 14 at a selectable period such as 32 Hz by applying a bias to terminal 27. If a coin is not present, the oscillator starts and provides an output signal to terminal 31 usually within 150 microseconds of the application of the bias to terminal 27. However if a coin is present the oscillator does not start and no signal appears at terminal 31. In this case, the microprocessor starts the sequence to place it in its operational mode in order to start the coin identification routine.

Figure 3:
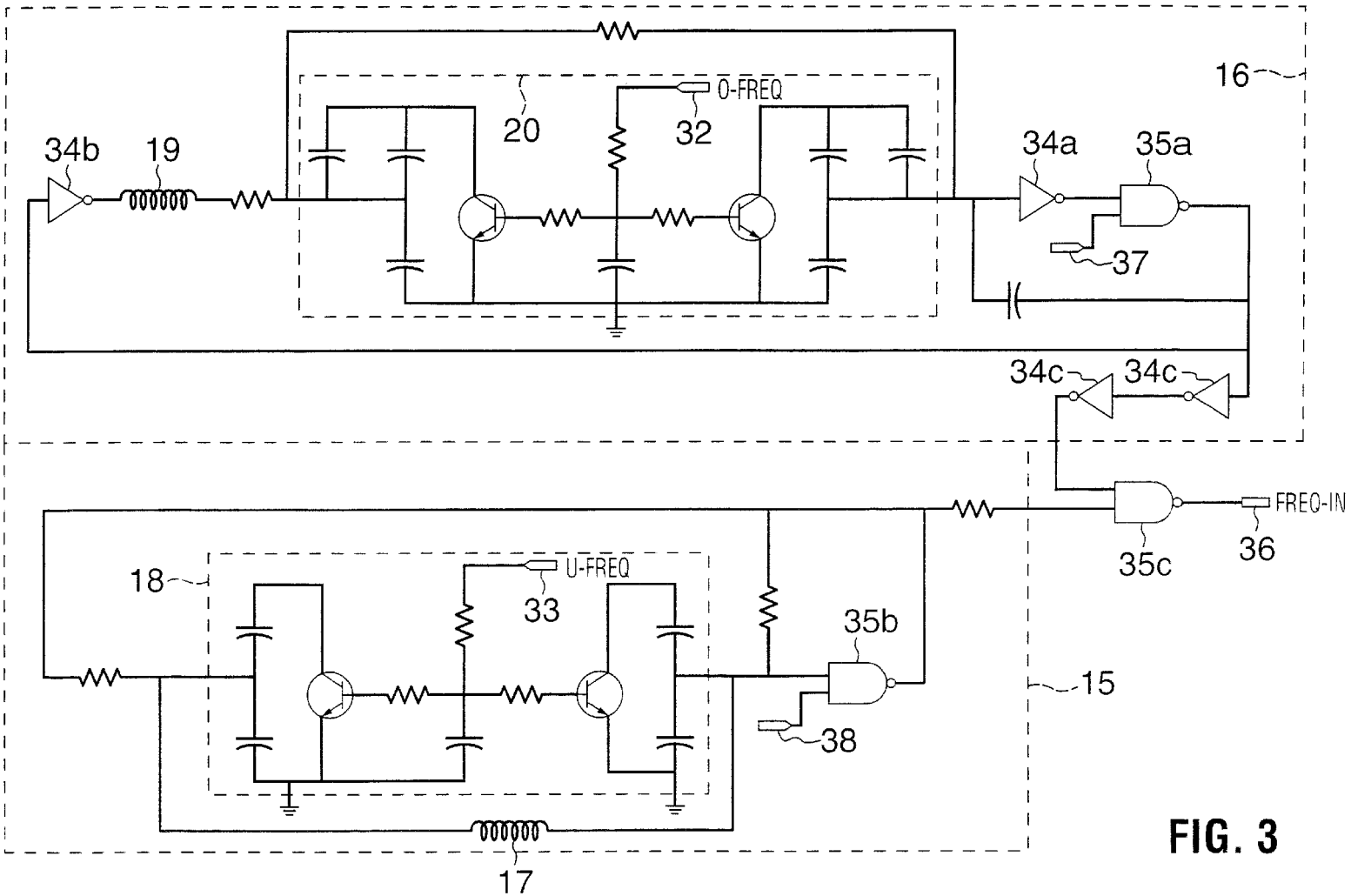
FIG. 3 illustrates one embodiment of the coin sensing circuits referred to in FIG. 1.

Referring to FIG. 3, the sensing circuit 16 includes a frequency selection oscillator circuit 20 and the coil arrangement 19. The oscillator circuit 20 is selected because the frequency of the oscillator is determined by the coil 19 and the capacitance of the oscillator circuit 20 in series with the coil 19. In addition, the frequency selection oscillator circuit 20 includes a terminal 32 that is connected the microprocessor 11 for selecting the base frequency of the frequency selection oscillator circuit 20. For example, the oscillating base frequency may be switched between a low frequency, typically 50 kHz, and a high frequency, typically 100 kHz. The sensing circuit 16 further includes a first inverter 34*a* that feeds NAND-gate 35*a* whose output is fed back to the oscillator circuit through inverter 34*b*. NAND-gate 35*a* is also connected to a NAND-gate 35*c* through two further inverters 34*c* and 34*d*. The output of NAND-gate 35*c* has a terminal 36 for coupling to the microprocessor 11. The second input to NAND-gate 35*a* has a terminal 37 coupled to the microprocessor 11 to turn the oscillator circuit 20 ON and OFF.

The sensing circuit 15 includes a frequency selection oscillator circuit 18 and a the coil arrangement 17. The oscillator circuit 18 is selected because the frequency of the oscillator is primarily determined by the coil 17 inductance and the capacitance of the oscillator circuit 18 in parallel with the coil 17. In addition, the frequency selection oscillator circuit 18 includes a terminal 33 that is connected the microprocessor 11 for selecting the base frequency of the frequency selection oscillator circuit 18. For example, the oscillator base frequency may be switched between a low frequency, typically 50 kHz, and a high frequency, typically 100 kHz. The sensing circuit 15 feeds a NAND-gate 35*b* whose output is fed back to the oscillator circuit 18. NAND-gate 35*b* is also connected to the second input of NAND-gate 35*c*. The second input to NAND-gate 35*b* has a terminal 38 coupled to the microprocessor 11 to turn the oscillator circuit 18 ON and OFF.

In operation, the microprocessor 11 will first switch ON the oscillator circuit 18 or 20 depending on which coil arrangement 17 or 19 respectively the coin will encounter falling down the chute. As the coin falls past the coil arrangement 17 or 19 the output of NAND-gate 35*c* is fed to the microprocessor 11 which will measure the frequency shift in the oscillator 18 or 20. As the coin continues to fall, the microprocessor 11 will switch OFF the oscillator circuit 18 or 20 that was ON and will switch ON the other oscillator circuit 18 or 20 that was OFF. The microprocessor will then measure the frequency shift as the coin passes by its respective coil arrangement 17 or 19. Thus at any one time, either both oscillator circuits 18 and 20 are OFF or only one of them is ON.

In another scenario, after the microprocessor 11 has measured the maximum frequency shift as the coin is passing by a coil arrangement 17 or 19, the microprocessor 11 will through terminals 32 or 33 respectively switch the base frequency of the oscillator circuit 18 or 20 from high to low or low to high and again measure the maximum frequency shift of the oscillator circuit 18 or 20 as the coin moves past the coin arrangement 17 or 19 respectively. This process will be repeated for both coil arrangements 17 and 19.

Figure 4:
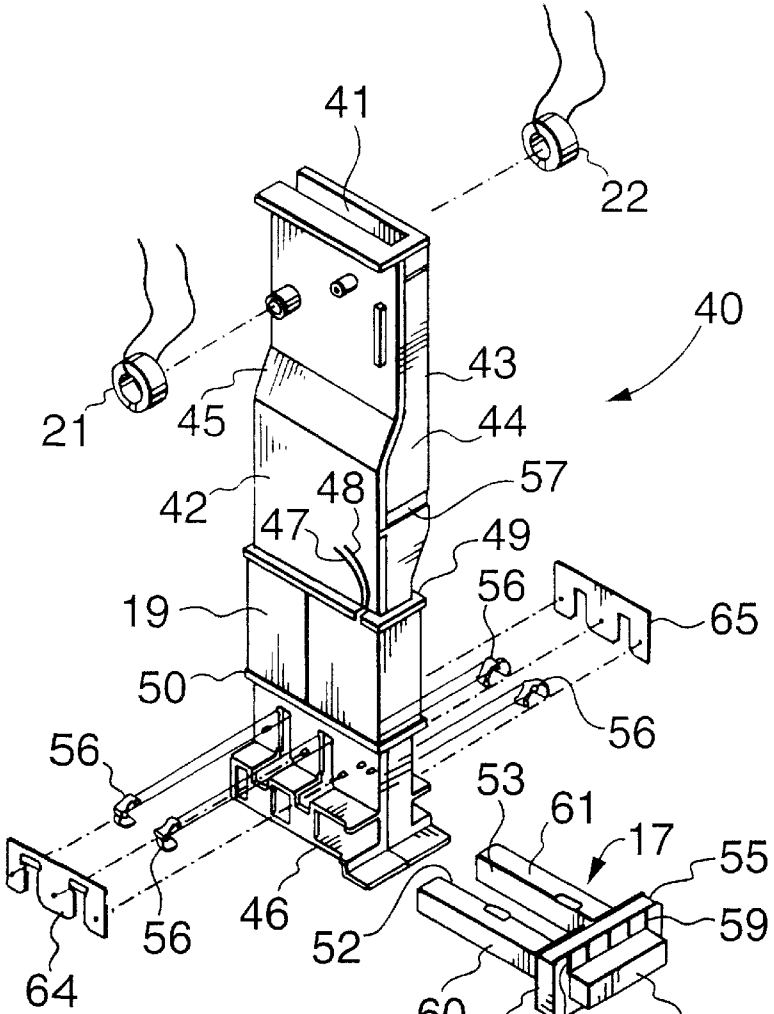
FIG. 4 is an exploded perspective view of a coin chute in accordance with the present invention.

FIG. 4 is an exploded perspective view of the coin chute 40 in accordance with the present invention. The coin chute 40 comprises an opening 41 at the top to receive a coin as well as front and back wall 42 and 43 and side walls 44 and 45 to guide the coin through a free fall path from the opening 41 to exit 46 at the bottom of chute 40. Chute 40 is narrow such that the plane of a coin is maintained substantially parallel to the walls 42 and 43 of the chute 40. Chute 40 which is molded from a polycarbonate material has an offset 57 midway down the chute 40. The offset 57 provides for a more secure coin path as it makes it less susceptible to fraudulent actions such as probing or fishing of coins on strings or other attachments. In addition, the offset 57 has the effect of quickly stabilizing coins inserted at high velocities, providing a more predictable coin flow through the lower regions of the chute 40 where the coil arrangements 17 and 19 are located. This particular coin flow in turn would tend to produce more consistent coin signatures.

The pair of coils 21 and 22 for the wake-up circuit 14 described in conjunction with FIG. 2, are positioned on the front and back walls 42 and 43 respectively near the coin opening 41.

Coil arrangement 19 that is connected to oscillator 20 by leads 47 and 48 consists of copper wire wrapped directly onto the chute 40 between bobbin type protrusions 49 and 50 molded into the chute walls 42 to 45, to form a type of oblong O-coil. As a coin passes through the O-coil 19, the base frequency of oscillator 20 shifts. The maximum amount of shift or the maximum percentage of frequency shift, as the coin passes through the coil is proportional to complex relationships of the diameter, thickness and type of material in the coin, so that coins that differ even slightly in one or more characteristic will cause a different frequency shift and therefore signature.

A number of pliable tabs 56 are inserted through the front and back walls 42 and 43 into the interior of the chute 40 and are held in place by retainers 64 and 65. These tabs 56 allow an unobstructed one-way passage of coins down the chute 40, however they prevent coins from being pulled out of the top opening 41 of the chute 40 after they have been detected as being valid payment for service.

Figure 5:
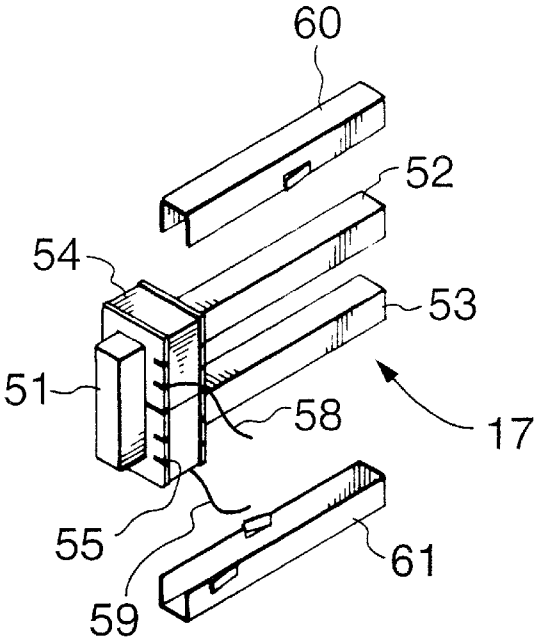
FIG. 5 is one embodiment of a U-coil used with the chute.

Coil arrangement 17 which is shown in more detail in FIG. 5, consists of a ferrite U-shaped core 51. The legs 52 and 53 of the core 51 are made sufficiently long to extend from one side 44 to the other side 45 of the chute 40 such that a coin falling through the chute will entirely pass between legs 52 and 53. Copper wire coils 54 and 55 are mounted on the legs 52 and 53 respectively. The two coils 54 and 55 are connected in series, however they may be replaced by a single coil mounted on the connecting arm between the legs 52 and 53. A pair of output leads 58 and 59 connect the coils 54 and 55 to oscillator 18. In order to provide greater sensitivity and consistent repeatable results, the ferrite core legs 52 and 53 are provided with shields 60 and 61 respectively that cover three sides and the end of each leg 52 and 53. The sides of the legs facing one another are not shielded to achieve an enhanced concentration of the flux lines by constraining the flux to the gap between the legs 52 and 53. Shields 60 and 61 are made from a highly conductive material such as brass.

Figure 6A:
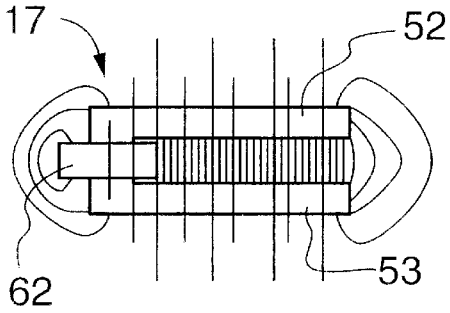
FIGS. 6A and 6B are top and end views of the flux distribution in the U-coil.
Figure 6B:
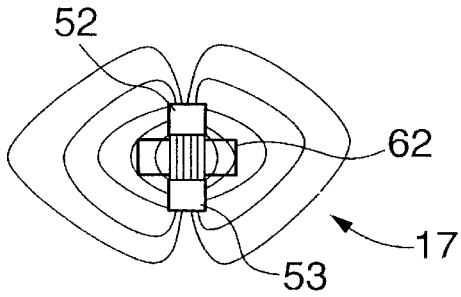
Figure 7A:
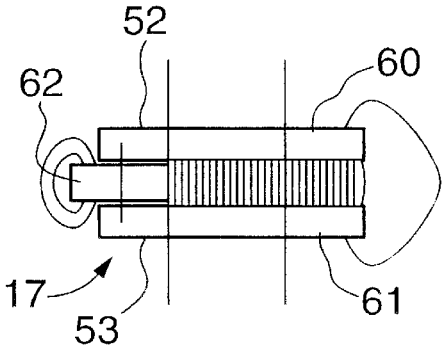
FIGS. 7A and 7B are top and end view of the flux distribution in the U-coil with shielding.
Figure 7B:
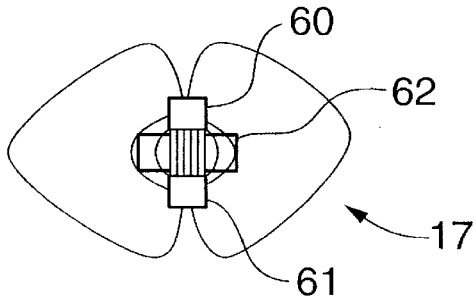
Figure 8A:
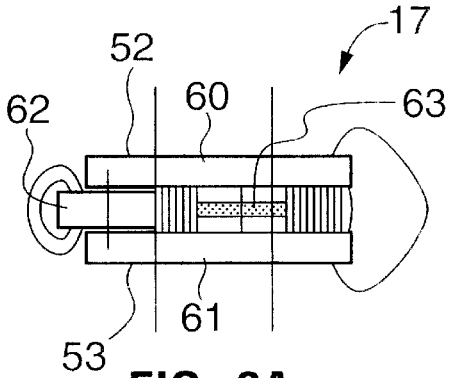
FIGS. 8A and 8B are top and end views of the flux distribution in the U-coil with shielding and a coin passing through it.
Figure 8B:
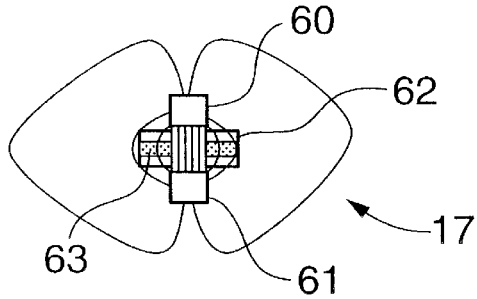

FIGS. 6A, 7A and 8A illustrate in side view the flux distribution about the legs 52 and 53 of U-coil 17 of the type described with respect to FIG. 5 except that they are shown with a single coil 62 wound about the arm connecting legs 52 and 53. FIGS. 6B, 7B and 8B are the end views of U-coil 17 shown in FIGS. 6A, 7A and 8A respectively. FIGS. 6A and 6B illustrate flux distribution about legs 52 and 53 when they do not have shields mounted on them. The flux distribution lines between legs 52 and 53 emanate from all sides of the legs 52 and 54 as well as from the ends of the legs. FIGS. 7A and 7B illustrate the same arrangement except that shields 61 and 62 are placed on the legs 52 and 53. This forces the flux distribution to be concentrated almost entirely in the gap between the sides of the legs 52 and 53 that face one another. As the shields 60 and 61 reduce the flux leakage, that is to say the flux not confined to the gap, better coin sensing and resulting signatures are achieved.

FIGS. 8A and 8B illustrate the event when a coin 63 passes through the gap between the legs 52 and 53 of coil arrangement 17. The conductivity of coin 63 prevents flux from passing through the coin 63 thereby reducing the overall number of flux lines in proportion to the overall size of the coin 63. Flux density therefore increases slightly in the area of the gap between legs 52 and 53 not occupied by the coin 63. In this particular situation, with the U-coil arrangement 17 connected to the oscillator circuit 18, the oscillator 18 base frequency will shift by a certain maximum percentage when the coin 63 passes through of legs 52 and 53. The percentage frequency shift is proportional to the diameter of the coin 63. There are second order relationships between the frequency shift and the thickness of the coin as well as between the frequency shift and the material used in the coin. However, experiments have shown that the percentage frequency shift is predominantly related to coin diameter.

Coin chute 40 may be a modular coin sensing unit in that it includes only the elements shown in FIG. 4 or it may be a modular self-contained coin identifying unit in that it also includes the wake-up circuit 14, the sensing circuits 15 and 16 as well as the microprocessor 11 and memory 12 mounted on the chute 40. Such a unit will have a connector to couple it to the parking meter or vending machine interface 13. In operation, when a coin is inserted into coin chute 40 through opening 41, the coin falls past wake-up coils 21 and 22, around the chute offset 57 then through coil arrangement 19, through anti-pullback mechanism 56, and finally past coil arrangement 17 after which it drops out of the chute through exit 46.

The coin sensing device in accordance with the present invention may be fitted into a metallic housing for shielding the coil arrangements 17 and 19 from external magnetic effects and may advantageously be provided to compensate the circuits and coils for ambient temperature variations.

Referring to FIGS. 1 and 4, microprocessor 11 controls the process for sensing a coin passing through the chute 40, for acquiring the signatures of the coin and for identifying the coin. The control process consists of the following steps starting when a coin is placed in the coin slot opening 41:

1. As the coin passes wake-up coils 21 and 22, a wake-up signal is generated by wake-up circuit 14 to place the microprocessor 11 in the operational mode.
2. Microprocessor starts oscillator 20.
3. Coin passing through O-coil 19 causes the oscillator 20 to shift frequency from its base frequency.
4. Maximum frequency shift for oscillator 20 is measured and converted to a first coin signature.
5. Microprocessor stops oscillator 20.
6. Microprocessor starts oscillator 18.
7. Coin passing through U-coil 17 causes the oscillator 18 to shift frequency from its base frequency.
8. Maximum frequency shift for oscillator 18 is measured and converted to a second coin signature.
9. Microprocessor stops oscillator 18.
10. First and second signatures are compared to equivalent first and second signatures stored in a table in memory to identify the coin in the chute 40.
11. Coin identity signal is sent to the parking meter or vending machine interface 13.

FIG. 9 is an example of a standard signature table expressed in percent frequency shift for nine different coins, coin #1 to coin #9. The table includes four reading ranges for each coin, one range for each of the coil arrangements identified as U and O taken at each of the base oscillating frequencies of 50 kHz and 100 kHz identified as low and high in the table. To establish a standard signature table of the type shown in FIG. 9 for a variety of coins, it is necessary to take a series of readings for each coin. The standard then consists of an average value which is shown in the upper half of the table with a minimum and maximum value for each coin which is shown in the lower half of the table.

In ideal conditions, two signatures would normally be adequate to identify most coins and the oscillators in the coin identifier might be operated at either the low frequency or the high frequency, or even possibly one oscillator at each frequency. Thus the resultant readings would be compared to the low frequency section or the high frequency section of the table, or a combination of the two.

However, since conditions such as weather and the treatment of the equipment by users, can vary considerably, it may be preferable to make additional readings. As can be seen from the table on FIG. 9, the percentage frequency shift of an oscillator for a particular coin is not the same when the oscillator operates at different frequencies. In view of this, the standard signature table of the type illustrated in FIG. 9 is compiled. Thus, to identify a coin, each oscillator 20 and 18 can be made to sequentially oscillate at two different base frequencies f1–f2 and f3–f4 respectively as the coin passes their respective coils 19 and 17 to provide four signatures for each coin. These signatures are then compared to the signatures in memory to identify the coin. It has been noted however that in most cases, a coin can be correctly identified using only three of the four signatures.

Though three out of four readings are usually sufficient for coins, the process may be used in other applications for identifying complex shapes by taking more then four signature readings, i.e. by having the oscillator operate at 3 or more base frequencies.

A control process for a system having each oscillator 20 and 18 operating at two base frequencies f1–f2 and f3–f4 could consist of the following steps starting when a coin is placed in the coin slot opening 41:

1. As the coin passes wake-up coils 21 and 22, a wake-up signal is generated by wake-up circuit 14 to place the microprocessor 11 in the operational mode.

2a. Microprocessor starts oscillator 20 at f1.

3a. Coin passing through O-coil 19 causes the oscillator 20 to shift from the base frequency f1.

4a. Maximum frequency shift for oscillator 20 operating at f1 is measured and converted to a first coin signature.

2b. Microprocessor switches oscillator to frequency f2.

4b. Maximum frequency shift for oscillator 20 operating at f2 is measured as the coin leaves the field and converted to a second coin signature.

5. Microprocessor stops oscillator 20.

6a. Microprocessor starts oscillator 18 at f3.

7a. Coin passing through U-coil 17 causes the oscillator 18 to shift from the base frequency f3.

8a. Maximum frequency shift for oscillator 18 operating at f3 is measured and converted to a third coin signature.

6b. Microprocessor switches oscillator 18 to frequency f4.

8b. Maximum frequency shift for oscillator 18 operating at f4 is measured as the coin leaves the field and converted to a fourth coin signature.

9. Microprocessor stops oscillator 18.

10. First, second, third and fourth signatures are sequentially compared to equivalent first, second, third and fourth signatures stored in memory to identify the coin in the chute 40.

11. Coin identity signal is provided to the parking meter interface.

In order to save processing time, step 10 above may be altered as follows:

10a. First and third signatures are compared to equivalent first and third signatures stored in memory to identify the coin in the chute 40;

10b. If the coin is not identified, then the second signature is compared to the equivalent second signature stored in memory to identify the coin in the chute 40;

10c. If the coin is still not identified, then the fourth signature is compared to the equivalent fourth signature stored in memory to identify the coin in the chute 40;

The oscillators 18 and 20 may be made to operate at frequencies of above 50 kHz, since below this frequency, it takes too long to make the frequency measurements. The identification of magnetic coins tends to be easier to do at lower frequencies whereas higher frequencies are preferred for non-magnetic coins. An ideal compromise would be to operate in the range of 50 to 100 kHz for the low frequency and above 100 kHz for the high frequency.

Many modifications in the above described embodiments of the invention can be carried out without departing from the scope thereof, and therefore the scope of the present invention is intended to be limited only by the appended claims.

What is claimed is:

1. A coin identification device comprising:

means for establishing two magnetic fields, each magnetic field adapted to sequentially oscillate at two or more base frequencies;

means for directing the coin to be identified through the two magnetic fields in a predetermined sequence wherein the flux lines in one of the magnetic fields are substantially parallel to the plane of a coin and sequentially oscillate at the two or more base frequencies as the coin passes through the field, and the flux lines in the other magnetic field are substantially perpendicular to the plane of the coin and sequentially oscillate at the two or more base frequencies as the coin passes through the field; and processor means for monitoring the magnetic fields for frequency shifts in the base frequencies as the coin passes through them to generate signature signals for the coin and for comparing the signatures to known coin signatures to determine the identity of the coin.

2. A coin identification device as claimed in claim 1 wherein the means for establishing the magnetic fields comprises:

two oscillators, each oscillator is adapted to sequentially oscillate at two or more base frequencies and has an electromagnet to generate one of the magnetic fields.

3. A coin identification device as claimed in claim 2 wherein:

the electromagnet for generating the magnetic field with flux lines parallel to the plane of the coin comprises a hollow coil adapted to have the coin pass through it; and the electromagnet for generating the magnetic field with flux lines perpendicular to the plane of the coin comprises a U-shaped core having two substantially parallel legs connected at one end by an arm with coil means mounted on the core and adapted to have the coin pass through the gap between the legs of the core.

4. A coin identification device as claimed in claim 3 wherein the oscillators are adapted to oscillate at substantially the same one or more base frequencies which are in the order of 100 kHz.

5. A coin identification device as claimed in claim 3 wherein each oscillator is adapted to sequentially oscillate at two distinct base frequencies under the control of the processor means as the coin passes through the magnetic field generated by the respective oscillator.

6. A coin identification device as claimed in claim 3 wherein shielding is located on the U-shaped core to concentrate the magnetic flux in the gap between the core legs.

7. A coin identification device as claimed in claim 2 wherein the means for directing the coin comprises a gravity fed chute structure having an opening for receiving the coin, walls to guide the coin as it moves downward and an opening for the coin to exit.

8. A coin identification device as claimed in claim 7 wherein:

the electromagnet for generating the magnetic field with flux lines parallel to the plane of the coin comprises a hollow coil adapted to have the coin pass through it; and the electromagnet for generating the magnetic field with flux lines perpendicular to the plane of the coin comprises a U-shaped core having two substantially parallel legs connected at one end by an arm with coil means mounted on the core and adapted to have the coin pass through the gap between the legs of the core.

9. A coin identification device as claimed in claim 8 wherein the chute includes an offset located along the coin path between the chute opening and the electromagnets to stabilize the coin before the coin passes through the electromagnets.

10. A coin identification device as claimed in claim 8 wherein the oscillators are adapted to oscillate at substantially the same base frequencies.

11. A coin identification device as claimed in claim 8 wherein each oscillator is adapted to sequentially oscillate at two distinct base frequencies under the control of the processor means as the coin passes through the magnetic field generated by the respective oscillator.

12. A coin identification device as claimed in claim 8 wherein shielding is located on the U-shaped core to concentrate the magnetic flux in the gap between the core legs.

13. A coin identification device as claimed in claim 2 wherein the processor means monitors the frequency shift of the oscillators as the coin passes through the magnetic fields generated by the respective oscillators.

14. A coin identification device as claimed in claim 13 wherein the processor means generates signature signals as a function of the maximum percent frequency shift of the oscillators from their base frequencies.

15. A coin identification device as claimed in claim 13 wherein the oscillators are adapted to oscillate at substantially the same base frequencies.

16. A coin identification device as claimed in claim 13 wherein each oscillator is adapted to sequentially oscillate at two distinct base frequencies under the control of the processor means as the coin passes through the magnetic field generated by the respective oscillator.

17. A coin identification device comprising:

a gravity fed chute structure having an opening for receiving a coin to be identified, walls to guide the coin as it moves through the chute and an opening for the coin to exit;

an oscillator adapted to sequentially oscillate at two or more base frequencies and including an electromagnet having a hollow coil mounted about the chute to have the coin pass through it;

an oscillator adapted to sequentially oscillate at two or more base frequencies and including an electromagnet having a U-shaped core with two substantially parallel legs connected at one end by an arm and coil means mounted on the core, the U-shaped core mounted about the chute to have the coin pass in the gap between the core legs; and processor means for monitoring the frequency shifts of the oscillators from their two or more base frequencies as the coin passes through their respective magnetic fields to generate three or more signatures for the coin, and for comparing the signatures to known coin signatures to determine the identity of the coin.

18. A coin identification device as claimed in claim 17 wherein the oscillators are adapted to oscillate at substantially the same base frequencies.

19. A coin identification device as claimed in claim 17 wherein each oscillator is adapted to sequentially oscillate at two distinct base frequencies under the control of the processor means as the coin passes through the magnetic field generated by the respective oscillator.

20. A coin identification device as claimed in claim 17 wherein shielding is located on the U-shaped core to concentrate the magnetic flux in the gap between the core legs.

21. A coin identification device as claimed in claim 17 wherein the chute includes an offset located along the coin path between the chute opening and the electromagnets to stabilize the coin before the coin passes through the electromagnets.

22. A coin identification process comprising:

(a) establishing two spatially separated magnetic fields adapted to sequentially oscillate at two or more base frequencies;

(b) directing the coin to be identified through one of the magnetic fields with a plane of the coin substantially parallel to the flux lines while the field sequentially oscillates at the two or more frequencies and through the other magnetic field with the plane of the coin substantially perpendicular to the flux lines while the field sequentially oscillates at the two or more frequencies;

(c) monitoring the flux lines parallel to the plane of the coin and the flux lines perpendicular to the plane of the coin for base frequency shifts as the coin passes through them to provide signatures representing characteristics of the coin; and (d) comparing the acquired signatures to known coin signatures to determine the identity of the coin.

23. A coin identification process as claimed in claim 22 wherein step (c) includes measuring the frequency shift of each of the oscillating magnetic fields as the coin passes through them.

24. A coin identification process as claimed in claim 23 wherein in step (b):

(b1) the coin is first directed through the oscillating magnetic field with the plane of the coin substantially parallel to the flux lines; and (b2) the coin is subsequently directed through the oscillating magnetic field with the plane of the coin substantially perpendicular to the flux lines.

25. A coin identification process as claimed in claim 22 wherein in step (a) includes:

(a1) switching one of the oscillating magnetic fields ON during at least the period that the coin is passing through it;

(a2) switching the one of the oscillating magnetic fields OFF;

(a3) switching the other of the oscillating magnetic fields ON during at least the period that the coin is passing through it; and (a4) switching the other of the oscillating magnetic fields OFF.

26. A coin identification process as claimed in claim 25 wherein in step (a1) includes:

(a11) causing the one of the oscillating magnetic fields to oscillate at a frequency f1 during an initial portion of the one ON period; and (a12) causing the one of the oscillating magnetic fields to oscillate at a frequency f2 during the remaining portion of the one ON period.

27. A coin identification process as claimed in claim 26 wherein in step (a3) includes:

(a31) causing the other of the oscillating magnetic fields to oscillate at a frequency f3 during an initial portion of the other ON period; and (a32) causing the other of the oscillating magnetic fields to oscillate at a frequency f4 during the remaining portion of the other ON period.

28. A coin identification process as claimed in claim 27 wherein f1=f3, f2=f4 and f1=f2.

29. A coin identification process as claimed in claim 27 wherein f1 f3, f1 f4, f2 f3 and f2 f4.

30. A coin identification process as claimed in claim 27 wherein step (c) includes:

(c1) measuring the frequency shift of the one oscillating magnetic field while it oscillates at the frequency f1 to provide a first signature;

(c2) measuring the frequency shift of the one oscillating magnetic field while it oscillates at the frequency f2 to provide a second signature;

(c3) measuring the frequency shift of the other oscillating magnetic field while it oscillates at the frequency f3 to provide a third signature; and (c4) measuring the frequency shift of the other oscillating magnetic field while it oscillates at the frequency f4 to provide a fourth signature.

31. A coin identification process as claimed in claim 30 wherein step (d) includes: comparing at least three of the acquired signatures to known coin signatures to determine the identity of the coin.

* * * * *

UNITED STATES PATENT AND TRADEMARK OFFICE

CERTIFICATE OF CORRECTION

PATENT NO. : 6,227,343 B1
DATED : May 8, 2001
INVENTOR(S) : Neathway et al.

It is certified that error appears in the above-identified patent and that said Letters Patent is hereby corrected as shown below:

Column 12,
Line 47, "f1 f3, f1 f4, f2 f3 and f2 f4" should be -- $f1 \neq f3$, $f1 \neq f4$, $f2 \neq f3$ and $f2 \neq f4$ --.

Signed and Sealed this

Fifth Day of November, 2002

*Attest:*

*Attesting Officer*

JAMES E. ROGAN
*Director of the United States Patent and Trademark Office*